United States Patent [19]

Kobayashi

[11] Patent Number: 4,625,143

[45] Date of Patent: Nov. 25, 1986

[54] MULTICOLOR COMPLEX TYPE CATHODE-RAY TUBE FOR USE AS LIGHT SOURCE

[75] Inventor: Hiroo Kobayashi, Kyoto, Japan

[73] Assignee: Mitsubishi Denki Kabushiki Kaisha, Tokyo, Japan

[21] Appl. No.: 652,025

[22] Filed: Sep. 19, 1984

[30] Foreign Application Priority Data

Nov. 10, 1983 [JP] Japan ..... 58-212682

[51] Int. Cl.[4] ..... H01J 29/50; H01J 29/52; H01J 29/10

[52] U.S. Cl. ..... 313/409; 313/415; 313/416; 313/461

[58] Field of Search ..... 313/409, 415, 416, 461, 313/495; 358/237, 88

[56] References Cited

FOREIGN PATENT DOCUMENTS

| | | | |
|---|---|---|---|
| 3011296 | 9/1980 | Fed. Rep. of Germany . | |
| 3011295 | 6/1982 | Fed. Rep. of Germany . | |
| 57-2080 | 12/1982 | Japan | 313/497 |
| 57-212763 | 12/1982 | Japan | 313/497 |
| 58-16457 | 1/1983 | Japan | 313/495 |
| 58-133752 | 8/1983 | Japan | 313/495 |
| 388560 | 3/1933 | United Kingdom . | |
| 543499 | 2/1942 | United Kingdom . | |
| 562168 | 6/1944 | United Kingdom . | |
| 684664 | 12/1952 | United Kingdom . | |
| 865663 | 4/1961 | United Kingdom . | |
| 922515 | 4/1963 | United Kingdom . | |
| 1354683 | 5/1974 | United Kingdom . | |

OTHER PUBLICATIONS

DE-Z: Funkschau 14, 1982, S.65-67.

*Primary Examiner*—Leo H. Boudreau
*Assistant Examiner*—M. Razavi
*Attorney, Agent, or Firm*—Sughrue, Mion, Zinn, Macpeak, and Seas

[57] ABSTRACT

A multicolor cathode-ray tube for use as a light source in a giant display system such as a display board for a sports stadium. The cathode-ray tube includes a plurality of electron guns and respective fluorescent screens, the latter receiving the beam from a corresponding electron gun. Each of the screens is slanted towards the longitudinal axis of the tube. The screens may be either flat or curved.

16 Claims, 6 Drawing Figures

MULTICOLOR COMPLEX TYPE CATHODE-RAY TUBE FOR USE AS LIGHT SOURCE

BACKGROUND OF THE INVENTION

The present invention relates to a multicolor cathode-ray tube of the complex type which is used to constitute picture elements in a giant color display system.

Conventionally, giant display systems used, for example, as a display board at a sports stadium, an advertisement or other message display mounted on a roof top or a wall surface of a building, or an information display for highway service, are composed of an array of a large number of incandescent electric lamps which are selectively turned on and off. These display systems suffer from a number of drawbacks. In the case of incandescent electric lamps, light is obtained by heating a filament to or nearly to a white-hot temperature, and accordingly the light emitted therefrom is, respectively, white or orange in color. It is quite difficult to cause such an electric lamp to emit light having a large component, for example, in the blue or green range. Moreover, circuits for turning on and off or varying the current applied to the filaments of the lamps are required for modulating the brightness of each picture element. Moreover, such electric lamps have a very low frequency of response, lower than 10 Hz. Thus, there is a problem that the output color changes depending on the applied current. Also, there is a difficulty in producing images in half-tone colors. Still further, in such a giant display system, generally from several thousand to more than ten thousand 20- to 40-watt electric lamps are required, and accordingly there are problems regarding power consumption, heat generation, and the like.

With the intent of remedying these difficulties, the inventor has proposed the use of cathode-ray tubes as light sources for such a display system. In such an system, small cathode-ray tubes, each having a monochromatic fluorescent screen for emitting, for instance, red, green and blue light, are arranged to display a desired picture image. This system has advantages in that not only is the efficiency in converting electric energy into light energy improved to a large extent in comparison with the use of ordinary incandescent electric lamps, but also light of any desired color can be obtained. Thus, in the case where cathode-ray tubes are employed as light sources in a giant display system, it is apparent that the system provides advantages in performance, reliability, maintenance, power consumption, and the like, in comparison with the conventional display system employing incandescent electric lamps.

FIG. 1 illustrates an example of a cathode-ray tube used as a light source in a giant display system, which is an embodiment of a previous invention made by the present inventor. In the drawing, reference numeral 1 designates a cylindrical envelop, the interior of which is at vacuum pressure. This envelope 1 has at one end a faceplate 3 coated on the inside with a fluorescent layer 2. An electron gun 5 is provided at the other end thereof. for flooding the entire fluorescent screen 2 with an unfocused electron beam 4. Terminals 6 are provided for applying required voltages to various elements of the electron gun 5, and a stem portion 7 encloses the envelope 1. Reference numerals 8, 9 and 10 respectively designate a heater, a cathode, and a grid, which together constitute the electron gun 5.

Further description will be made with respect to the operation of the cathode-ray tube. With a negative voltage applied to the grid 10 relative to the cathode 9, a current is supplied to the heater 8 so as to heat the cathode 9 to cause the voltage of the grid 10 to approach the potential of the cathode 9 to thereby cause the cahode 8 to emit the electron beam 4 toward the fluorescent screen 2. The electron beam 4 is an unfocused beam confined within a predetermined solid angle ($\theta$), the value of which is determined by various factors such as the diameter of a hole 11 formed at the center of the grid 10, the distance between the grid 10 and the cathode 9, and the anode voltage. This beam causes the fluorescent screen 2 to phosphoresce in a color determined by the type of phosphor.

Numbers of such cathode-ray tubes are regularly arranged with the screen side of each of tube forward, for example, as shown in FIG. 2. The cathode-ray tubes are arranged generally such that, in each row, one cathode-ray tube 22 emitting red light and an adjacent cathode-ray tube 23 emitting blue light are disposed between two cathode-ray tubes 21 emitting green light. In one example of such a display system, cathode-ray tubes each having a diameter of about 29 mm were arranged at intervals of about 40 to 45 mm. This interval was chosen to allow for waterproofing of the structure. The optimum viewing distance of the system is about 70 m or more in view of the clarity of the image as well as color reproduction, which distance is quite suitable for applications such as sports stadiums. However, for applications such as indoor displays or outdoor advertising displays, it has been found that the optimum viewing distance is about half that in the case of a sports stadium.

To reduce the optimum viewing distance, an embodiment has been proposed in which the fluorescent screen of each cathode-ray tube is divided into a plurality of sections, each of which emits light in a different primary color. FIG. 3 shows an example of such a cathode-ray tube 31, in which a fluorescent screen 2 is divided around the center into three fan-shaped sections which respectively generate primary color rays of red, green and blue. In the cathode-ray tube 31, for example, as shown in FIG. 4, individual electron guns 5*a* are provided for generating unfocused electron beams 4*a* directed to respective fluorescent screens 2*a*. In this case, the respective fluorescent screens 2*a* are supported on fluorescent screen targets 12*a*.

SUMMARY OF THE INVENTION

In accordance with the present invention, there is provided a multicolor cathode-ray tube of the complex type for use as a light source in a giant display system having a fluorescent screen as described above, in which each of the respective fluorescent screen targets is formed with a flat or curved surface slanted toward the longitudinal axis of the tube. The effect is to increase the effective area of the fluorescent screen, that is to increase the quantity of light output therefrom.

DESCRIPTION OF THE PREFERRED EMBODIMENTS

Figure 1:
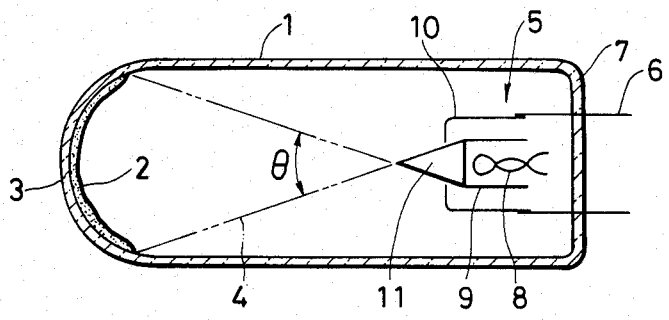
FIG. 1 PRIOR ART
FIG. 1 is a partially fragmentary sectional side view of a conventional single-tube monochromatic cathode-ray tube for use as a light source.
Figure 2:
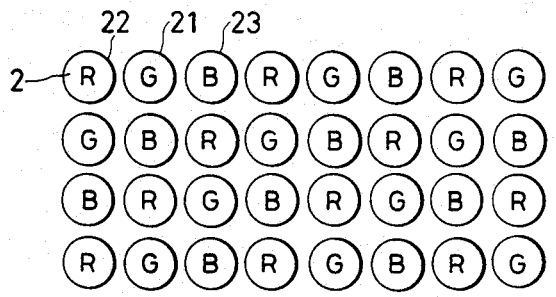
FIG. 2 PRIOR ART
FIG. 2 is a diagram showing an arrangement of multiple ones of the cathode-ray tube of FIG. 1.
Figure 3:
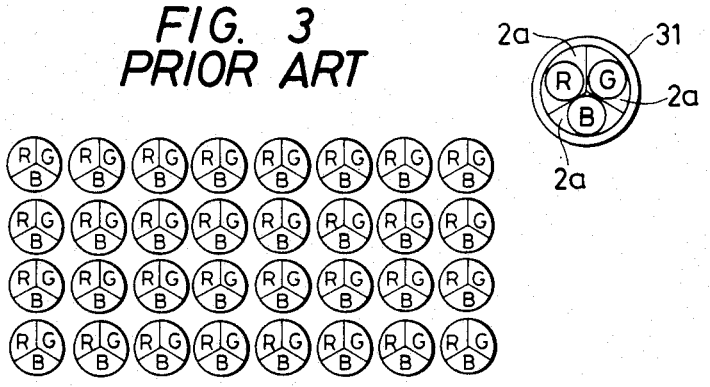
FIG. 3 PRIOR ART
FIG. 3 is a diagram showing an arrangement of single-tube three-color cathode-ray tubes for use as light sources.
Figure 4:
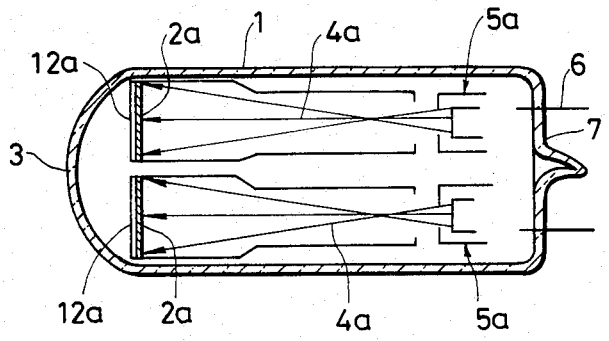
FIG. 4 PRIOR ART
FIG. 4 is a partially fragmentary sectional side view of the cathode-ray tube shown in FIG. 3.
Figure 5:
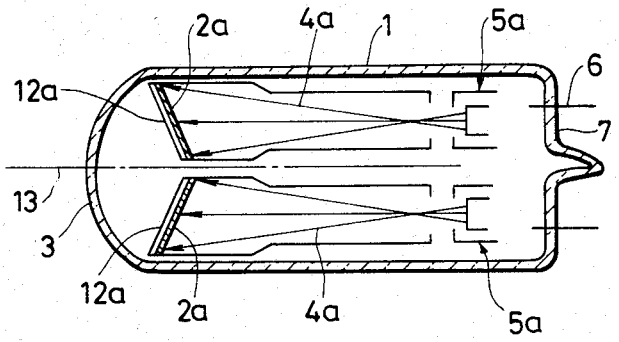
FIG. 5 is a partially fragmentary sectional side view of a multicolor complex type cathode-ray tube for use as a light source according to a preferred embodiment of the present invention.
Figure 6:
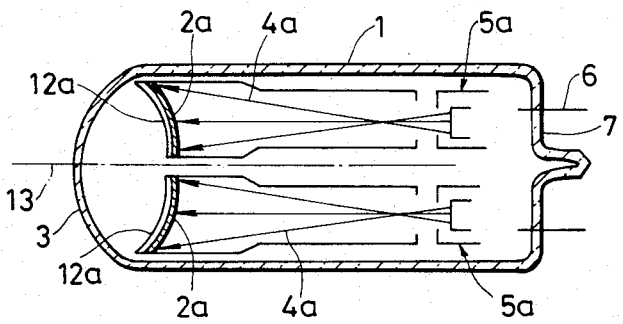
FIG. 6 is a partially fragmentary sectional side view of a multicolor complex type cathode-ray tube for use as a light source according to another embodiment of the present invention.

Referring to FIGS. 5 and 6 of the drawings, preferred embodiments of the invention will now be described.

FIG. 5 is a cross-sectional view of a multicolor complex-type cathode-ray tube for use as a light source in a giant display system according to a first preferred embodiment of the invention. In this figure, each fluorescent screen target 12*a* is flat and slanted toward the direction of the longitudinal axis 13 of the tube.

FIG. 6 shows another embodiment of the present invention. In this embodiment, each of the fluorescent screen targets 12*a* has a curved surface, which may be in the shape of a segment of a sphere, and which is slanted toward the direction of the longitudinal axis 13 of the tube in a similar fashion to the first-described embodiment.

The arrangement of other components is basically the same as in the conventional case.

According to the present invention, as described above with respect to FIGS. 5 and 6, each of the fluorescent screen targets 12*a* is formed as a flat or curved surface which is slanted in the axial direction of the tube. This increases the effective area of the fluorescent screens and hence increases the luminous output. That is, the luminous output of the cathode-ray tube of the invention substantially depends on the effective area of the fluorescent screens, and thus increasing the area of the screens has a large effect on the luminous output.

Due to the arrangement whereby each of the fluorescent screens 12*a* is slanted toward the axial direction of the tube, the luminous flux is directed inwardly so as to obtain an additional effect that the emitted light rays can be easily mixed.

As described above, according to the present invention, each of the fluorescent screen targets is formed as a flat or curved surface slanted in the axial direction of the tube so as to increase the effective area of the fluorescent screen to thus increase the luminous output, whereby a multicolor complex type cathode-ray tube which presents a bright and clear picture image is obtained.

I claim:

1. A multicolor cathode-ray tube of the complex type for use as a light source, comprising:

a cylindrical envelope having a facing surface at one end thereof and a stem portion at the other end thereof;

a plurality of electron guns, positioned in said stem portion of said cylindrical envelope, for generating respective unfocused electron beams along a longitudinal axis of said tube toward said facing surface of said cylindrical envelope; and a plurality of fluorescent screens positioned in said cylindrical envelope toward said facing surface to receive electron beams from respective ones of said electron guns, each of said screens being slanted toward a direction of said longitudinal axis of said cylindrical envelope, such that a distance between said screens and said electron guns increases in the direction from a central axis of said envelope to a side wall of said envelope.

2. The multicolor cathode-ray tube according to claim 1, wherein said fluorescent screens emit different colors.

3. The multicolor cathode-ray tube according to claim 2, wherein colors emitted from said fluorescent screens are red, green and blue.

4. The multicolor cathode-ray tube according to claim 1, wherein each of said electron beams is an unfocused beam which is irradiated onto an entire surface of a respective one of said fluorescent screens.

5. The multicolor cathode-ray tube according to claim 1, wherein said fluorescent screens are flat.

6. The multicolor cathode-ray tube according to claim 1, wherein said fluorescent screens are curved.

7. A multicolor cathode-ray tube of the complex type for use as a light source, comprising:

a cylindrical envelope having a facing surface at one end thereof and a stem portion at the other end thereof;

a plurality of electron guns, positioned within said stem portion of said envelope, for generating respective independent, non-overlapping electron beams; and a plurality of fluorescent screens positioned in said cylindrical envelope toward said facing surface to receive electron beams from respective ones of said electron guns, each of said screens being slanted toward a direction of said longitudinal axis of said cylindrical envelope, such that a distance between said screens and said electron guns increases in the direction from a central axis of said envelope to a side wall of said envelope.

8. The multicolor cathode-ray tube according to claim 7, wherein said fluorescent screens emit different colors.

9. The multicolor cathode-ray tube according to claim 8, wherein colors emitted from said fluorescent screens are red, green and blue.

10. The multicolor cathode-ray tube according to claim 7, wherein each of said electron beams is an unfocused beam which is irradiated onto an entire surface of a respective one of said fluorescent screens.

11. The multicolor cathode-ray tube according to claim 7, wherein said fluorescent screens are flat.

12. The multicolor cathode-ray tube according to claim 1, wherein said fluorescent screens are curved.

13. A multicolor cathode-ray tube of the complex type for use as a light source, comprising:

a cylindrical envelope;

a plurality of electron guns for generating respective independent electron beams along a longitudinal axis of said tube, said electron guns being provided at one end of and in said envelope; and a plurality of fluorescent screens positioned to receive electron beams from respective ones of said electron guns, each of said screens being slanted toward the direction of the longitudinal axis of said tube such that a distance between said screen and said electron gun increases in the direction from a central axis of said envelope to a side wall of said envelope.

14. The multicolor cathode-ray tube according to claim 13, wherein said fluorescent screens emit different colors.

15. The multicolor cathode-ray tube according to claim 14, wherein colors emitted from said fluorescent screens are red, green and blue.

16. The multicolor cathode-ray tube according to claim 13, wherein each of said electron beams is an unfocused beam which is irradiated onto an entire surface of a respective one of said fluorescent screens.

* * * * *